US008747088B2

(12) United States Patent
Elson et al.

(10) Patent No.: US 8,747,088 B2
(45) Date of Patent: Jun. 10, 2014

(54) OPEN DRIVE SCROLL COMPRESSOR WITH LUBRICATION SYSTEM

(75) Inventors: John P. Elson, Sidney, OH (US); Jeffrey L. Berning, Fort Loramie, OH (US); John P. Sheridan, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 1092 days.

(21) Appl. No.: 12/274,843

(22) Filed: Nov. 20, 2008

(65) Prior Publication Data

US 2009/0136372 A1 May 28, 2009

Related U.S. Application Data

(60) Provisional application No. 60/990,489, filed on Nov. 27, 2007.

(51) Int. Cl.

| | |
|---|---|
| ***F04C 18/02*** | (2006.01) |
| ***F04C 2/02*** | (2006.01) |
| ***F01C 1/02*** | (2006.01) |
| ***F01C 21/04*** | (2006.01) |
| ***F04C 29/02*** | (2006.01) |

(52) U.S. Cl.

CPC ..... *F04C 18/0215* (2013.01); *F04C 29/023* (2013.01); *F04C 29/02* (2013.01); *Y10S 418/01* (2013.01)

USPC ..... 418/55.6; 418/89; 418/94; 418/100; 418/DIG. 1; 184/6.16

(58) Field of Classification Search

CPC ..... F04C 18/0215; F04C 29/02; F04C 29/023

USPC ..... 418/55.6, 55.1, 89, 94, 100, 270, 418/DIG. 1; 184/6.16

See application file for complete search history.

(56) References Cited

U.S. PATENT DOCUMENTS

| | | | |
|---|---|---|---|
| 3,462,072 | A | 8/1969 | Schibbye |
| 3,777,509 | A | 12/1973 | Muench |

(Continued)

FOREIGN PATENT DOCUMENTS

| | | |
|---|---|---|
| JP | 6153488 | 3/1986 |
| JP | 06-010859 | 1/1994 |

(Continued)

OTHER PUBLICATIONS

"The Rotary Vane Principle," http:www.hydrovane.co.uk/vaneprinciples1.asp?area=, 2 pages, printed Dec. 22, 2005.

(Continued)

*Primary Examiner* — Mary A Davis

(74) *Attorney, Agent, or Firm* — Harness, Dickey & Pierce, P.L.C.

(57) ABSTRACT

A compressor may include a compressor housing, an oil sump, an intake chamber, a compression mechanism, a drive shaft, and a first oil passage. The oil sump may be in communication with the compression mechanism. The intake chamber may be defined within the housing. The drive shaft may include first and second ends with an oil inlet passage located therebetween. The first end may be disposed within the intake chamber and may be drivingly engaged with the compression mechanism. The second end may extend outside of the housing for driven engagement external to the housing. The oil inlet passage may be located within the intake chamber. The first oil passage may be disposed within the housing and in communication with the oil sump and the oil inlet passage.

20 Claims, 1 Drawing Sheet

(56) References Cited

U.S. PATENT DOCUMENTS

| | | | | | |
|---|---|---|---|---|---|
| 3,796,526 | A | | 3/1974 | Cawley | |
| 3,945,216 | A | | 3/1976 | Schibbye | |
| 4,080,119 | A | | 3/1978 | Eriksson | |
| 4,112,701 | A | | 9/1978 | Schibbye et al. | |
| 4,140,337 | A | | 2/1979 | Arcella et al. | |
| 4,289,334 | A | | 9/1981 | Riley | |
| 4,312,187 | A | | 1/1982 | Myers | |
| 4,332,535 | A | * | 6/1982 | Terauchi et al. | 418/55.6 |
| 4,343,599 | A | | 8/1982 | Kousokabe | |
| 4,400,020 | A | | 8/1983 | Keller | |
| 4,439,121 | A | | 3/1984 | Shaw | |
| 4,449,895 | A | | 5/1984 | Kurahayashi | |
| 4,456,437 | A | | 6/1984 | Kurahayashi et al. | |
| 4,470,772 | A | | 9/1984 | Gannaway | |
| 4,477,233 | A | | 10/1984 | Schaefer | |
| 4,568,256 | A | * | 2/1986 | Blain | 418/55.6 |
| 4,623,306 | A | | 11/1986 | Nakamura et al. | |
| 4,674,963 | A | | 6/1987 | Morishita et al. | |
| 4,676,075 | A | | 6/1987 | Shiibayashi | |
| 4,758,136 | A | | 7/1988 | Pamlin et al. | |
| 4,818,198 | A | | 4/1989 | Tamura et al. | |
| 4,850,197 | A | | 7/1989 | Taylor et al. | |
| 4,863,357 | A | | 9/1989 | Olofsson | |
| 4,895,498 | A | | 1/1990 | Basseggio | |
| 4,898,521 | A | | 2/1990 | Sakurai et al. | |
| 4,917,582 | A | | 4/1990 | Fraser, Jr. et al. | |
| 4,946,361 | A | | 8/1990 | DeBlois et al. | |
| 5,027,606 | A | | 7/1991 | Short | |
| 5,037,282 | A | | 8/1991 | Englund | |
| 5,040,382 | A | | 8/1991 | Abraham | |
| 5,063,750 | A | | 11/1991 | Englund | |
| 5,076,771 | A | | 12/1991 | Ban et al. | |
| 5,102,316 | A | | 4/1992 | Caillat et al. | |
| 5,103,652 | A | | 4/1992 | Mizuno et al. | |
| 5,110,268 | A | | 5/1992 | Sakurai et al. | |
| 5,112,201 | A | | 5/1992 | Tamura et al. | |
| 5,131,497 | A | | 7/1992 | Rogers | |
| 5,137,437 | A | | 8/1992 | Machida et al. | |
| 5,197,868 | A | | 3/1993 | Caillat et al. | |
| 5,228,301 | A | | 7/1993 | Sjoholm et al. | |
| 5,246,357 | A | | 9/1993 | Sjoholm et al. | |
| 5,277,564 | A | | 1/1994 | Tamura et al. | |
| 5,328,340 | A | | 7/1994 | Hara et al. | |
| 5,330,335 | A | * | 7/1994 | Teracuhi et al. | 418/55.6 |
| 5,345,785 | A | | 9/1994 | Sekigami et al. | |
| 5,358,392 | A | | 10/1994 | Ukai | |
| 5,370,513 | A | | 12/1994 | Fain | |
| 5,391,066 | A | | 2/1995 | Sawai et al. | |
| 5,466,136 | A | | 11/1995 | Yamada et al. | |
| 5,580,230 | A | | 12/1996 | Keifer et al. | |
| 5,580,233 | A | | 12/1996 | Wakana et al. | |
| 5,591,018 | A | | 1/1997 | Takeuchi et al. | |
| 5,630,712 | A | | 5/1997 | Sakai et al. | |
| 5,634,345 | A | | 6/1997 | Alsenz | |
| 5,645,408 | A | | 7/1997 | Fujio et al. | |
| 5,660,539 | A | | 8/1997 | Matsunaga et al. | |
| 5,667,371 | A | | 9/1997 | Prenger et al. | |
| 5,678,986 | A | | 10/1997 | Terauchi et al. | |
| 5,678,987 | A | | 10/1997 | Timuska | |
| 5,683,237 | A | | 11/1997 | Hagiwara et al. | |
| 5,685,168 | A | | 11/1997 | Sada | |
| 5,727,936 | A | | 3/1998 | Eriksson et al. | |
| 5,735,139 | A | | 4/1998 | Lord et al. | |
| 5,810,572 | A | | 9/1998 | Yamamoto et al. | |
| 5,829,959 | A | | 11/1998 | Tsubono et al. | |
| 5,931,650 | A | | 8/1999 | Yasu et al. | |
| 5,964,581 | A | | 10/1999 | Iizuka et al. | |
| 6,039,551 | A | | 3/2000 | Takeuchi et al. | |
| 6,044,660 | A | | 4/2000 | Numoto et al. | |
| 6,050,794 | A | | 4/2000 | Noboru et al. | |
| 6,053,715 | A | | 4/2000 | Hirano et al. | |
| 6,086,343 | A | | 7/2000 | Sun et al. | |
| 6,116,877 | A | | 9/2000 | Takeuchi et al. | |
| 6,129,531 | A | * | 10/2000 | Elson et al. | 418/55.6 |
| 6,167,719 | B1 | | 1/2001 | Yakumaru et al. | |
| 6,171,076 | B1 | | 1/2001 | Gannaway | |
| 6,183,227 | B1 | | 2/2001 | Hida et al. | |
| 6,220,839 | B1 | | 4/2001 | Sheridan et al. | |
| 6,227,828 | B1 | | 5/2001 | Takeuchi et al. | |
| 6,264,446 | B1 | | 7/2001 | Rajendran et al. | |
| 6,273,693 | B2 | | 8/2001 | Hida et al. | |
| 6,322,339 | B1 | | 11/2001 | Mitsunaga et al. | |
| 6,422,842 | B2 | | 7/2002 | Sheridan et al. | |
| 6,428,296 | B1 | | 8/2002 | Elson et al. | |
| 6,461,132 | B1 | | 10/2002 | Sun et al. | |
| 6,467,287 | B2 | | 10/2002 | Sjoholm et al. | |
| 6,478,551 | B1 | | 11/2002 | Nonaka | |
| 6,478,557 | B2 | | 11/2002 | Shiibayashi et al. | |
| 6,499,967 | B2 | | 12/2002 | Hansen | |
| 6,506,039 | B1 | | 1/2003 | Osumimoto et al. | |
| 6,511,530 | B2 | | 1/2003 | Iwanami et al. | |
| 6,517,328 | B2 | | 2/2003 | Makino et al. | |
| 6,682,322 | B2 | | 1/2004 | Funakoshi et al. | |
| 6,718,781 | B2 | | 4/2004 | Freund et al. | |
| 6,739,833 | B2 | | 5/2004 | Makino et al. | |
| 6,896,496 | B2 | | 5/2005 | Haller et al. | |
| 7,566,210 | B2 | * | 7/2009 | Elson et al. | 418/55.6 |
| 2003/0059319 | A1 | | 3/2003 | Haller et al. | |
| 2007/0092391 | A1 | | 4/2007 | Elson et al. | |

FOREIGN PATENT DOCUMENTS

| | | | | | |
|---|---|---|---|---|---|
| JP | 2000130368 | A | | 5/2000 | |
| JP | 2000161266 | | | 6/2000 | |
| JP | 2000161266 | A | * | 6/2000 | F04C 18/02 |
| JP | 2000291574 | | | 10/2000 | |
| JP | 2000291574 | A | * | 10/2000 | F04C 18/02 |
| JP | 2001099075 | | | 4/2001 | |
| JP | 2007146864 | | | 6/2007 | |

OTHER PUBLICATIONS

"S391 Screw Compressor Specifications," Thermos King Northwest, copyright 2002, 1 page.

International Search Report regarding International Application No. PCT/US2008/013115 dated Apr. 27, 2009.

Written Opinion of the International Searching Authority regarding International Application No. PCT/US2008/013115 dated Apr. 27, 2009.

International Preliminary Report on Patentability regarding International Application No. PCT/US2008/013115, dated Jun. 1, 2010.

Second Office Action regarding China Application No. 200880118042.8 dated Jul. 30, 2013. Translation provided by Unitalen Attorneys at Law.

First Office Action regarding China Application No. 200880118042.8 dated Oct. 9, 2012. Translation provided by Unitalen Attorneys at Law.

Search Report regarding China Application No. 200880118042.8 dated Sep. 27, 2012. Translation provided by Unitalen Attorneys at Law.

Notification of Reexamination regarding China Application No. 200680038668.9 dated Jan. 9, 2014. Translation provided by Unitalen Attorneys At Law.

* cited by examiner

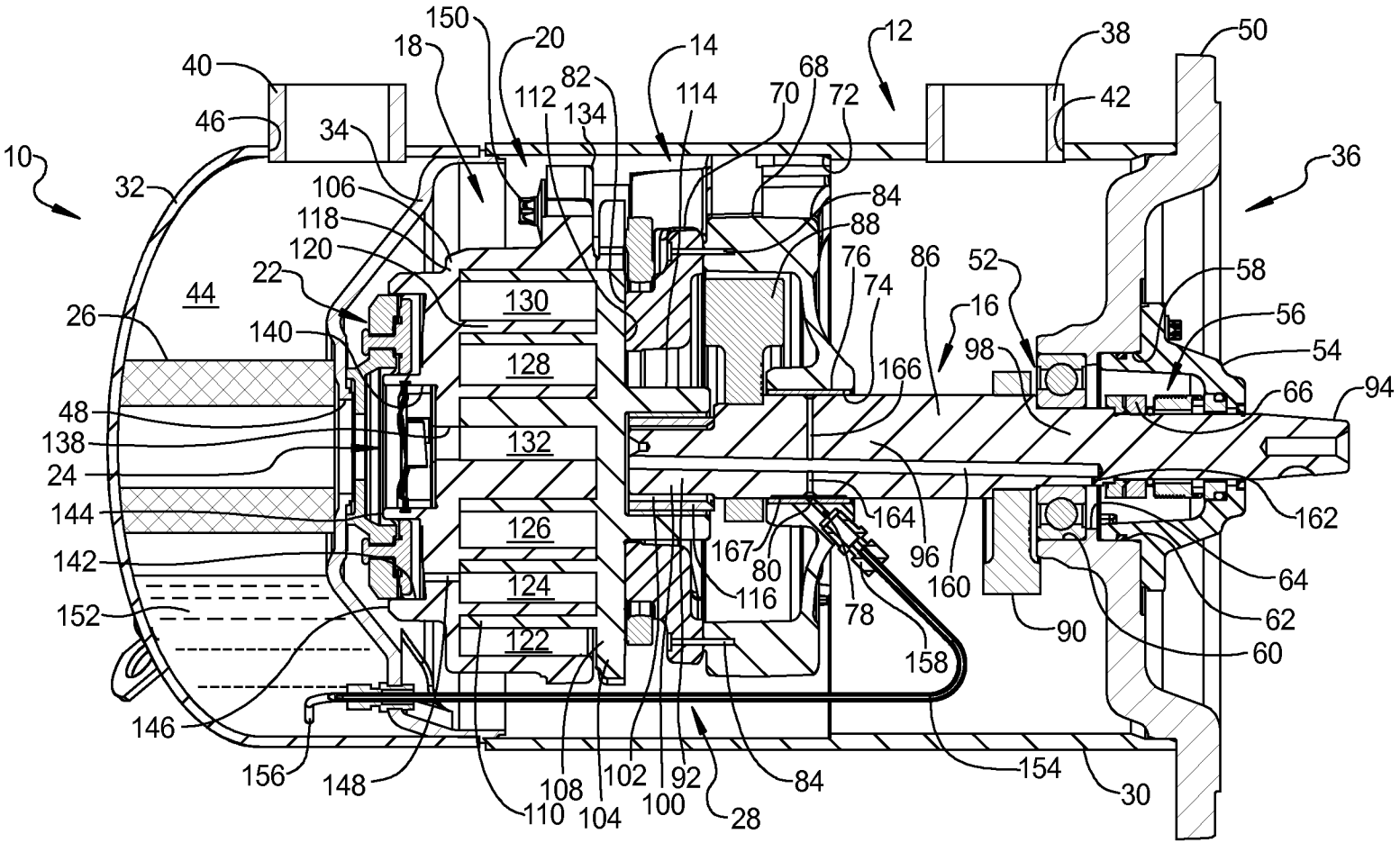
10
12
14
16
18
20
22
24
26
28
30
32
34
36
38
40
42
44
46
48
50
52
54
56
58
60
62
64
66
68
70
72
74
76
78
80
82
84
86
88
90
92
94
96
98
100
102
104
106
108
110
112
114
116
118
120
122
124
126
128
130
132
134
138
140
142
144
146
148
150
152
154
156
158
160
162
164
166
167

OPEN DRIVE SCROLL COMPRESSOR WITH LUBRICATION SYSTEM

CROSS-REFERENCE TO RELATED APPLICATIONS

This application claims the benefit of U.S. Provisional Application No. 60/990,489, filed on Nov. 27, 2007. The entire disclosure of the above application is incorporated herein by reference.

FIELD

The present disclosure relates to compressor lubrication systems.

BACKGROUND

This section provides background information related to the present disclosure which is not necessarily prior art.

Compressors may include a drive shaft that drives a compression mechanism. The drive shaft may be rotatably supported in a bearing housing. Lubricating oil may be used to reduce friction at the interface between the drive shaft and bearing housing.

SUMMARY

This section provides a general summary of the disclosure, and is not a comprehensive disclosure of its full scope or all of its features.

A compressor may include a compressor housing, an oil sump, an intake chamber, a compression mechanism, a drive shaft, and a first oil passage. The intake chamber may be defined within the housing. The compression mechanism may include first and second members supported for relative orbital displacement and may be disposed within the housing to move a fluid from the intake chamber to the oil sump. The drive shaft may include first and second ends with an oil inlet passage located therebetween. The first end may be disposed within the intake chamber and may be drivingly engaged with the compression mechanism. The second end may extend outside of the housing for driven engagement external to the housing. The oil inlet passage may be located within the intake chamber. The first oil passage may be disposed within the housing and in communication with the oil sump and the oil inlet passage.

The compressor may further include a first bearing housing supported within the intake chamber and including a second oil passage therein in communication with the first oil passage. The drive shaft may be bearingly supported by the first bearing housing at a location between the first and second ends. The oil inlet passage may be in communication with the second oil passage. The compressor may further include a second bearing housing supported within the intake chamber and bearingly supporting the drive shaft at a location between the first bearing housing and the second end of the drive shaft. The drive shaft may include an oil outlet passage disposed within the intake chamber between the oil inlet passage and the second end of the drive shaft to provide an oil flow to the second bearing housing. The drive shaft may include a third oil passage extending along an axial length of the drive shaft at a radially outward angle relative to an axis of rotation of the drive shaft from the oil inlet passage toward the second end of the drive shaft. The third oil passage may extend at a radially inward angle relative to an axis of rotation of the drive shaft from the oil inlet passage toward the first end of the drive shaft. The third oil passage may be in communication with the oil outlet passage.

A first gas pressure within the oil sump may be greater than a second gas pressure within the intake chamber and may urge oil in the oil sump into the first oil passage and into the oil inlet passage. The oil inlet passage may include an inlet opening extending through a radially outer wall of the drive shaft. The inlet opening may be in communication with the first oil passage. The first and second members may include first and second scroll members meshingly engaged with one another.

A compressor may include a compressor housing, an oil sump, an intake chamber, a compression mechanism, and a drive shaft. The intake chamber may be defined within the housing. The compression mechanism may be disposed within the housing to move a fluid from the intake chamber to the oil sump. The drive shaft may include a first end drivingly engaged with the compression mechanism, a second end, and a first oil passage. The first oil passage may extend at a radially outward angle relative to an axis of rotation of the drive shaft in a direction from a first end toward the second end. The compressor may further include a second oil passage disposed within the housing and in communication with the oil sump and the first oil passage.

The second end of the drive shaft may extend outside of the housing for driven engagement with a power source.

The drive shaft may include an oil inlet passage in communication with the first oil passage and located within the intake chamber. The compressor may further include a first bearing housing supported within the intake chamber and including a third oil passage therein in communication with the second oil passage. The drive shaft may be bearingly supported by the first bearing housing at a location between the first and second ends. The oil inlet passage may be in communication with the third oil passage. The compressor may further include a second bearing housing supported within the intake chamber and bearingly supporting the drive shaft at a location between the first bearing housing and the second end of the drive shaft. The drive shaft may include an oil outlet passage disposed within the intake chamber between the oil inlet passage and the second end of the drive shaft to provide an oil flow to the second bearing housing. The oil inlet passage may include an inlet opening extending through a radially outer wall of the drive shaft. The inlet opening may be in communication with the second oil passage.

A first gas pressure within the oil sump may be greater than a second gas pressure within the intake chamber and may urge oil in the oil sump into the first oil passage and into the oil inlet passage. The first and second members may include first and second scroll members meshingly engaged with one another.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

FIG. 1 is a sectional view of a compressor according to the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors. For exemplary purposes, compressor 10 is shown as a horizontal scroll compressor.

With reference to FIG. 1, compressor 10 may include a compressor housing assembly 12, a main bearing housing assembly 14, a drive shaft assembly 16, a compression mechanism 18, a retaining assembly 20, a seal assembly 22, a discharge valve assembly 24, an oil separator 26, and an oil feed mechanism 28. Housing assembly 12 may include a cylindrical hermetic shell 30, an end cap 32, a transversely extending partition 34, a base assembly 36, a suction gas inlet fitting 38, and a refrigerant discharge fitting 40.

Cylindrical hermetic shell 30 may include an opening 42 having suction gas inlet fitting 38 attached thereto. End cap 32 and transversely extending partition 34 may generally define a discharge chamber 44. More specifically, transversely extending partition 34 may be fixed to a first end of shell 30 and end cap 32 may be fixed to transversely extending partition 34. End cap 32 may include an opening 46 having refrigerant discharge fitting 40 fixed thereto. Partition 34 may include an opening 48 to provide fluid communication between compression mechanism 18 and discharge chamber 44. Discharge chamber 44 may generally form a discharge muffler for compressor 10. However, while compressor 10 is shown including discharge chamber 44, it is understood that the present teachings apply equally to direct discharge configurations. Base assembly 36 may be fixed to shell 30 at an end generally opposite partition 34.

Base assembly 36 may include a base member 50, a bearing assembly 52, a seal housing 54, and a seal assembly 56. Base member 50 may include a central opening 58 including first and second portions 60, 62 and a radially inwardly extending protrusion 64 disposed therebetween. Bearing assembly 52 may be located in first portion 60 of opening 58 and may include a ball bearing assembly. Seal housing 54 may be located in second portion 62 of opening 58 and may be fixed to base member 50. Seal assembly 56 may be located within seal housing 54 and may include a shaft seal 66.

Main bearing housing assembly 14 may include a main bearing housing 68 and a thrust member 70. Main bearing housing 68 may be press fit into shell 30 and may abut a step 72 therein to locate main bearing housing 68 within shell 30. Main bearing housing 68 may define a central bore 74, having a bearing 76 disposed therein. An oil passage 78 may extend radially inwardly through main bearing housing 68. A corresponding opening 80 may extend through bearing 76 to provide fluid communication between oil passage 78 and an interior portion of bearing 76. Thrust member 70 may be fixed to an end of main bearing housing 68 and may form an annular flat thrust bearing surface 82 for engagement with compression mechanism 18, as discussed below. More specifically, fasteners 84 may extend through thrust member 70 and main bearing housing 68 to couple thrust member 70 thereto.

Drive shaft assembly 16 may include a drive shaft 86, a first counterweight 88 and a second counterweight 90. Drive shaft 86 may include first and second ends 92, 94 and first and second journal portions 96, 98 disposed therebetween. First end 92 may include an eccentric crank pin 100 having a flat 102 thereon. Second end 94 may extend axially past base assembly 36 and may be disposed external to housing assembly 12. A drive mechanism (not shown) may engage second end 94 to power rotation of drive shaft 86. First and second journal portions 96, 98 may be rotatably disposed within bearing 76 and bearing assembly 52, respectively. Shaft seal 66 may be sealingly engaged with drive shaft 86 at a location between second end 94 and second journal portion 98 to prevent leakage of oil from housing assembly 12. First counterweight 88 may be fixed to drive shaft 86 at a location between first end 92 and first journal portion 96 and second counterweight 90 may be fixed to drive shaft 86 at a location between first journal portion 96 and second journal portion 98.

Compression mechanism 18 may include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with thrust bearing surface 82 on main bearing housing 68. A cylindrical hub 114 may project downwardly from thrust surface 112 and may have a drive bushing 116 rotatably disposed therein. Drive bushing 116 may include an inner bore in which crank pin 100 is drivingly disposed. Crank pin flat 102 may drivingly engage a flat surface in a portion of the inner bore of drive bushing 116 to provide a radially compliant driving arrangement.

Non-orbiting scroll 106 may include an end plate 118 having a spiral wrap 120 on a lower surface thereof. Spiral wrap 120 may form a meshing engagement with wrap 110 of orbiting scroll 104, thereby creating an inlet pocket 122, intermediate pockets 124, 126, 128, 130 and an outlet pocket 132. Non-orbiting scroll 106 may be axially displaceable relative to main bearing housing 68, housing assembly 12, and orbiting scroll 104. More specifically, non-orbiting scroll 106 may include a series of flanges 134 including bores (not shown) extending therethrough. Flanges 134 may cooperate with retaining assembly 20 to provide for axial displacement of non-orbiting scroll 106, as discussed below.

Non-orbiting scroll 106 may include a discharge passageway 138 in communication with outlet pocket 132 and upwardly open recess 140 which may be in fluid communication with discharge chamber 44 via opening 48 in partition 34. Non-orbiting scroll 106 may additionally include an annular recess 142 in the upper surface thereof defined by parallel coaxial inner and outer side walls 144, 146. Annular recess 142 may provide for axial biasing of non-orbiting scroll 106 relative to orbiting scroll 104, as discussed below. More specifically, a passage 148 may extend through end plate 118 of non-orbiting scroll 106, placing recess 142 in fluid communication with intermediate pocket 124. While passage 148 is shown extending to intermediate pocket 124, it is understood that passage 148 may alternatively be placed in communication with any of the other intermediate pockets.

Retaining assembly 20 may couple non-orbiting scroll 106 to main bearing housing assembly 14 for axial displacement relative thereto. Retaining assembly 20 may include a fastener 150 such as a bolt. Fastener 150 may extending through the bore in flange 134 and may be threadingly engaged with main bearing housing assembly 14. Seal assembly 22 may include a floating seal assembly. Seal assembly 22 may sealingly engage partition 34 to isolate the discharge pressure region from the suction pressure region and may sealingly engage non-orbiting scroll 106 to isolate annular recess 142 from the suction and discharge pressure regions.

Discharge valve assembly 24 may be fixed to non-orbiting scroll 106 and may generally prevent reverse flow through discharge passageway 138 during shut-down of compressor 10. An oil sump 152 may be in communication with discharge chamber 44. Oil separator 26 may be located downstream of discharge valve assembly 24. Oil separator 26 may provide separation of oil entrained within discharge gas exiting compression mechanism 18. Oil removed from the discharge gas by oil separator 26 may return to oil sump 152. In the present non-limiting example, oil sump 152 is shown defined within discharge chamber 44 generally opposite discharge fitting 40. However, it is understood that compressor 10 is not limited to internal oil sump arrangements and the present teachings apply equally to alternate oil sump arrangements. For example, oil sump 152 and oil separator 26 may be located in a separate housing external to compressor 10 and in communication with discharge chamber 44.

Oil feed mechanism 28 may include an oil feed tube 154 in communication with oil sump 152. Oil feed tube 154 may pass through partition 34 and provide fluid communication between oil sump 152 and main bearing housing assembly 14. More specifically, a first end 156 of oil feed tube 154 may extend into oil sump 152 and a second end 158 of oil feed tube 154 may be fixed to main bearing housing 68 and may be in communication with oil passage 78 therein.

Drive shaft 86 may include a central oil passage 160, and first, second, and third radially extending oil passages 162, 164, 166. Central oil passage 160 may extend longitudinally within drive shaft 86 through first end 92 of drive shaft 86 and may terminate at a location before second end 94. Central oil passage 160 may extend at an angle of less than 3 degrees relative to a rotational axis of drive shaft 86. More specifically, central oil passage 160 may extend at an angle radially outwardly in a direction from first end 92 to second end 94 of drive shaft 86. An end of central oil passage 160 proximate first radially extending oil passage 162 may be disposed radially outwardly relative to an end of central oil passage 160 proximate first end 92 of drive shaft 86. Central oil passage 160 may therefore pump oil to first radially extending oil passage 162.

First radially extending oil passage 162 may intersect central oil passage 160 at a location proximate bearing assembly 52. More specifically, first radially extending oil passage 162 may be located longitudinally between bearing assembly 52 and seal assembly 56 and may extend at approximately a 90 degree angle relative to the rotational axis of drive shaft 86. First radially extending oil passage 162 may have a diameter of between 2.0 mm and 3.0 mm, and more specifically, approximately 2.5 mm to meter an oil flow therethrough.

Second and third radially extending oil passages 164, 166 may intersect central oil passage 160 at a location proximate bearing 76 of main bearing housing 68. More specifically, second and third radially extending oil passages 164, 166 may be longitudinally aligned with opening 80 in bearing 76. Second and third radially extending oil passages 164, 166 may be disposed generally opposite one another, or approximately 180 degrees apart. Second and third radially extending oil passages 164, 166 may each extend at approximately a 90 degree angle relative to the rotational axis of drive shaft 86. Second and third radially extending oil passages 164, 166 may be sized to meter an oil flow into central oil passage 160. For example, second and third radially extending oil passages 164, 166 may have diameters of 3.0 mm to 4.0 mm. Drive shaft 86 may include a flat 167 that forms a recess between drive shaft 86 and bearing 76 to lubricate bearing 76.

During operation, compression mechanism 18 may provide a fluid flow to oil sump 152. The fluid flow may include a combination of discharge gas and entrained oil. The discharge gas pressures generated by compression mechanism 18 may act on the oil volume within oil sump 152 to force oil into oil feed tube 154. Oil may be supplied to main bearing housing 68 and bearing 76 through opening 80 to provide lubrication between bearing 76 and first journal portion 96 of drive shaft 86. The discharge gas pressures acting on oil sump 152 may be sufficient to overcome any centrifugal pressures generated by rotation of second and third radially extending oil passages 164, 166. For example, discharge gas pressures may be more than 10 times the centrifugal pressure generated by rotation of second and third radially extending oil passages 164, 166, and more specifically greater than 25 times the centrifugal pressure generated by rotation of second and third radially extending oil passages 164, 166. In the present non-limiting example, the discharge gas pressure may generally be the pressure within discharge chamber 44.

The pressure acting upon oil in discharge chamber 44 may therefore force oil into second and third radially extending oil passages 164, 166 and into central oil passage 160. The angular orientation of central oil passage 160 may pump oil to first radially extending oil passage 162 to provide lubrication between bearing assembly 52 and second journal portion 98 of drive shaft 86. Oil may return to oil sump 152 by being drawn into compression mechanism 18 with suction gas and forced into discharge chamber 44.

The first radially extending oil passage 162 may be sized to maintain an oil pressure within central oil passage 160 sufficient to force an oil flow from first end 92 of drive shaft 86 toward main bearing housing 68. The oil flow from first end 92 may collect in a region of main bearing housing 68 adjacent to first counterweight 88. Rotation of first counterweight 88 may displace oil toward annular flat thrust bearing surface 82, providing lubrication for annular flat thrust bearing surface 82, as well as for orbiting and non-orbiting scrolls 104, 106.

What is claimed is:

1. A compressor comprising:

a compressor housing;

an oil sump;

an intake chamber defined within said compressor housing;

a compression mechanism including first and second members supported for relative orbital displacement and disposed within said compressor housing to move a fluid from said intake chamber to said oil sump;

a drive shaft having first and second ends with an oil inlet passage located therebetween, said first end disposed within said intake chamber and drivingly engaged with said compression mechanism, said second end extending outside of said compressor housing for driven engagement external to said compressor housing, said oil inlet passage being located within said intake chamber and including an inlet opening extending through an outer radial wall of said drive shaft;

first and second bearing housings disposed within said intake chamber and supporting said drive shaft, said second bearing housing disposed between said first bearing housing and said second end; and a first oil passage disposed within said intake chamber of said compressor housing and having a first end in communication with said oil sump and a second end in communication with said inlet opening of said oil inlet passage, wherein said drive shaft includes an oil outlet passage disposed within said intake chamber between said oil inlet passage and said second end of said drive shaft to provide an oil flow to said second bearing housing.

2. The compressor of claim 1, wherein said first bearing housing includes a second oil passage therein in communication with said first oil passage.

3. The compressor of claim 2, wherein said drive shaft is bearingly supported by said first bearing housing at a location between said first and second ends and said oil inlet passage is in communication with said second oil passage.

4. The compressor of claim 2, wherein said drive shaft includes a third oil passage extending along an axial length of said drive shaft at a radially outward angle relative to an axis of rotation of said drive shaft from said oil inlet passage toward said second end of said drive shaft.

5. The compressor of claim 2, wherein a third oil passage extends at a radially inward angle relative to an axis of rotation of said drive shaft from said oil inlet passage toward said first end of said drive shaft.

6. The compressor of claim 5, wherein said third oil passage is in communication with an oil outlet passage defined in said drive shaft.

7. The compressor of claim 1, wherein a first gas pressure within said oil sump is greater than a second gas pressure within said intake chamber, said first gas pressure urging oil in said oil sump into said first oil passage and into said oil inlet passage.

8. The compressor of claim 1, wherein said first and second members include first and second scroll members meshingly engaged with one another.

9. A compressor comprising:

a compressor housing;

an oil sump;

an intake chamber defined within said compressor housing;

a compression mechanism disposed within said compressor housing to move a fluid from said intake chamber to said oil sump;

a drive shaft having a first end drivingly engaged with said compression mechanism, a second end, an oil inlet passage extending within said drive shaft at a location axially between said first and second ends and including an inlet opening extending through an outer radial wall of said drive shaft, and a first oil passage in communication with said oil inlet passage and extending within an interior of said drive shaft at a radially outward angle relative to an axis of rotation of said drive shaft past said oil inlet passage in a direction from said first end toward said second end; and a second oil passage disposed within said compressor housing and in communication with said oil sump and said first oil passage.

10. The compressor of claim 9, wherein said second end of said drive shaft extends outside of said compressor housing for driven engagement with a power source.

11. The compressor of claim 9, further comprising a first bearing housing supported within said intake chamber and including a third oil passage therein in communication with said second oil passage.

12. The compressor of claim 11, wherein said drive shaft is bearingly supported by said first bearing housing at a location between said first and second ends and said oil inlet passage is in communication with said third oil passage.

13. The compressor of claim 11, further comprising a second bearing housing supported within said intake chamber bearingly supporting said drive shaft at a location between said first bearing housing and said second end of said drive shaft, said first oil passage having an axial extent from said first end of said drive shaft to said second bearing housing.

14. The compressor of claim 13, wherein said drive shaft includes an oil outlet passage disposed within said intake chamber between said oil inlet passage and said second end of said drive shaft to provide an oil flow to said second bearing housing.

15. The compressor of claim 9, wherein said inlet opening is in communication with said second oil passage.

16. The compressor of claim 9, wherein a first gas pressure within said oil sump is greater than a second gas pressure within said intake chamber, said first gas pressure urging oil in said oil sump into said first oil passage and into said oil inlet passage defined in said drive shaft.

17. The compressor of claim 9, wherein said compression mechanism includes first and second scroll members meshingly engaged with one another.

18. A compressor comprising:

a compressor housing;

an oil sump;

an intake chamber defined within said compressor housing;

a compression mechanism disposed within said compressor housing to move a fluid from said intake chamber to said oil sump;

a drive shaft having first and second ends with an oil inlet passage located therebetween, said first end disposed within said intake chamber and drivingly engaged with said compression mechanism, said second end extending outside of said compressor housing for driven engagement external to said compressor housing, said oil inlet passage being located within said intake chamber and including an inlet opening extending through an outer radial wall of said drive shaft; and a first oil passage disposed within said intake chamber of said compressor housing and having a first end in communication with said oil sump and a second end in communication with said inlet opening of said oil inlet passage, wherein said drive shaft includes a second oil passage extending along an axial length of said drive shaft at a radially outward angle relative to an axis of rotation of said drive shaft from said oil inlet passage toward said second end of said drive shaft.

19. The compressor of claim 18, further comprising first and second bearing housings disposed within said intake chamber and supporting said drive shaft, said second bearing housing disposed between said first bearing housing and said second end, wherein said drive shaft includes an oil outlet passage disposed within said intake chamber between said oil inlet passage and said second end of said drive shaft to provide an oil flow to said second bearing housing.

20. The compressor of claim 19, wherein said drive shaft includes another oil inlet passage including another inlet opening extending through said outer radial wall of said drive shaft and communicating with said first and second oil passages, wherein said oil inlet passages are disposed 180 degrees apart.

* * * * *